US009664372B1

(12) United States Patent
Rothschild

(10) Patent No.: US 9,664,372 B1
(45) Date of Patent: May 30, 2017

(54) ILLUMINATION HARNESS WITH SLIDING VERTICAL TRACK SUPPORT

(71) Applicant: Sound Shore Innovations L.L.C., Darien, CT (US)

(72) Inventor: Kyle D. Rothschild, Darien, CT (US)

(73) Assignee: Sound Shore Innovations L.L.C., Darien, CT (US)

( * ) Notice: Subject to any disclaimer, the term of this patent is extended or adjusted under 35 U.S.C. 154(b) by 0 days.

(21) Appl. No.: 15/347,850

(22) Filed: Nov. 10, 2016

Related U.S. Application Data

(63) Continuation of application No. 15/147,057, filed on May 5, 2016.

(51) Int. Cl.

| | |
|---|---|
| ***F21V 21/34*** | (2006.01) |
| ***F21V 21/08*** | (2006.01) |
| ***F21V 33/00*** | (2006.01) |
| ***F21L 4/00*** | (2006.01) |
| ***F21V 5/04*** | (2006.01) |
| ***F21V 23/04*** | (2006.01) |
| ***F21V 19/02*** | (2006.01) |
| ***F21V 23/00*** | (2015.01) |
| ***A41F 15/00*** | (2006.01) |
| ***A41D 1/00*** | (2006.01) |
| ***A41F 9/02*** | (2006.01) |

(52) U.S. Cl.
CPC ..... *F21V 33/0008* (2013.01); *A41D 1/002* (2013.01); *A41F 9/025* (2013.01); *A41F 15/002* (2013.01); *F21L 4/00* (2013.01); *F21V 5/04* (2013.01); *F21V 19/02* (2013.01); *F21V 23/001* (2013.01); *F21V 23/0407* (2013.01); *F21V 23/0414* (2013.01)

(58) Field of Classification Search
CPC .... F21W 2111/10; F21L 4/00; F21V 21/0816; F21V 21/0832; F21V 21/34
See application file for complete search history.

(56) References Cited

U.S. PATENT DOCUMENTS

| | | | | |
|---|---|---|---|---|
| 112,436 A * | 3/1871 | Fessenden | ..... | A41D 13/01 362/108 |
| 295,982 A * | 4/1884 | Conwell | ..... | A41D 13/01 116/63 R |
| 630,157 A | 8/1899 | Worth | | |

(Continued)

FOREIGN PATENT DOCUMENTS

| | | |
|---|---|---|
| DE | 3343864 A1 | 6/1985 |
| DE | 10054730 A1 | 5/2002 |
| EP | 1677049 A2 | 7/2006 |

OTHER PUBLICATIONS

Black Diamond, ICON Headlamp—2014, Mar. 18, 2015.

(Continued)

*Primary Examiner* — Ismael Negron
(74) *Attorney, Agent, or Firm* — Mark Nowotarski

(57) ABSTRACT

An illumination harness with sliding vertical track support has an adjustable waist belt, an adjustable shoulder strap, a forward facing illumination light and a vertical track that the light is frictionally mounted on. The vertical track is mounted at the front midpoint of the waste belt and extends upward. The light is frictionally mounted so that its vertical position can be adjusted by hand, but it will remain in place when hanging by its own weight.

15 Claims, 10 Drawing Sheets

(56) References Cited

U.S. PATENT DOCUMENTS

| | | | | | |
|---|---|---|---|---|---|
| 1,217,666 | A * | 2/1917 | Thulin | F21L 4/00 | 224/907 |
| 1,825,088 | A * | 9/1931 | Powell | F21L 15/08 | 362/108 |
| 2,320,193 | A | 5/1943 | Powell et al. | | |
| 2,555,871 | A | 6/1951 | Caggiano | | |
| 2,710,338 | A | 6/1955 | Svalgaard | | |
| 4,631,645 | A * | 12/1986 | Lenart | F21L 15/14 | 362/105 |
| 4,764,962 | A | 8/1988 | Ekman et al. | | |
| 4,888,671 | A * | 12/1989 | Reimer | F21V 21/34 | 362/249.16 |
| 5,624,065 | A | 4/1997 | Steffe | | |
| 5,655,833 | A * | 8/1997 | Raczynski | F21S 6/002 | 248/125.3 |
| 5,915,609 | A | 6/1999 | Diakoulas | | |
| 6,095,657 | A * | 8/2000 | Kent | F21L 11/00 | 362/108 |
| 6,517,214 | B1 | 2/2003 | Mitchell, Jr. et al. | | |
| 7,210,605 | B2 | 5/2007 | Willows et al. | | |
| 7,828,455 | B2 * | 11/2010 | Barker | F21L 4/04 | 362/103 |
| 7,922,349 | B2 | 4/2011 | Hunnewell et al. | | |
| 2006/0176681 | A1 * | 8/2006 | Krimmer | A63B 69/0028 | 362/108 |
| 2007/0177376 | A1 | 8/2007 | Simoni | | |
| 2010/0277894 | A1 * | 11/2010 | Kim | F21L 4/00 | 362/105 |
| 2011/0038142 | A1 * | 2/2011 | Ritter | F21V 21/145 | 362/108 |
| 2013/0093133 | A1 | 4/2013 | Hashimoto | | |
| 2013/0194784 | A1 * | 8/2013 | Yu | F21V 21/0816 | 362/108 |
| 2014/0268685 | A1 | 9/2014 | McLisky | | |

OTHER PUBLICATIONS

Barefoot Heretic, GoMotion Reactor Vest Product Review, https://barefootheretic.wordpress.com/2013/03/18/gomotion-reactor-vest-product-review/, Apr. 4, 2016.

Amazon.com, Flectson™ Reflective Vest/Belt Provides 360 Degree High Visibility for your Safety Outdoors: Running, Biking, Jogging etc., http://www.amazon.com/dp/B00QJRHJ5C?psc=1, Mar. 13, 2015.

Sicklines Review: Hydrapak Laguna, http://www.sicklines.com/reviews/review-hydrapak-laguna/, Mar. 3, 2016.

Amazon.com, Nathlan Light Fit Vest Safety, Yellow, Mar. 13, 2015.

Wikipedia.com, Piping (sewing), https://en.wikipedia.org/wiki/Piping_(sewing), Mar. 11, 2016.

Broichhausen, Hans; English Translation DE 3343864 A1, Slide fastener with welt for large-area, textile wall elements, publication date Jun. 13, 1985.

Mueller, Uwe; English Translation DE 10054730, Clip fastening for upholstery cover comprises piping, flat support, seat frame, foam padding, base plate and holes through, publication date May 16, 2002.

Gallay et al., English Translation EP 1677049 A2, Portable lamp adapted to be worn by a person, publication date Jul. 5, 2006.

* cited by examiner

ILLUMINATION HARNESS WITH SLIDING VERTICAL TRACK SUPPORT

COPYRIGHT AND TRADEMARK NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

FIELD OF INVENTION

The inventions described herein are in the field of shoulder supported lights.

BACKGROUND OF THE INVENTION

There is a long felt need for an illumination light system that can be worn while a person runs. As used herein, an illumination light is a light that produces a directed beam of light to illuminate an object so that said object is visible to a person. FIG. 1 is an illustration of a prior art illumination light system 100 worn by a runner 108. This figure is based on FIG. 1 of U.S. Pat. No. 7,828,455 (Barker). The illumination light system comprises a chest strap 102 worn around a runner's torso 106. An illumination light 104 is mounted on the chest strap and is directed forward and downward to project a beam of light 112 on a path 114 in front of the runner. The illumination light is directed in the sense that the divergence angle 122 of the light beam is relatively small. A divergence angle of 90 degrees or less is considered small.

One of the limitations of the prior art illumination light system is that it can slip down 118 on the runner's torso due to the pounding of the runner's feet. There is need, therefore, for an illumination light system that can keep an illumination light on a person's torso when they run.

SUMMARY

The summary of the invention is provided as a guide to understanding the invention. It does not necessarily describe the most generic embodiment of the invention or the broadest range of alternative embodiments.

An illumination harness is an illumination light system that has an adjustable waist belt, an adjustable shoulder strap, a forward facing illumination light and a vertical track that the light is frictionally mounted on. The vertical track is mounted on the front end of the shoulder strap at about the front midpoint of the waist belt. The light is frictionally mounted so that its vertical position can be adjusted by hand, but it will remain in place when released and hanging by its own weight. People with different body types can wear the harness with the waist belt at different heights on their bodies. The vertical track allows people to adjust the height of the light so that it will be at a desired position on their torsos irrespective of where they wear the waist belt.

LIST OF FIGURES

DETAILED DESCRIPTION

The detailed description describes non-limiting exemplary embodiments. Any individual features may be combined with other features as required by different applications for at least the benefits described herein.

As used herein, the term "about" means plus or minus 10% of a given value unless specifically indicated otherwise.

As used herein, a "computer-based system" comprises an input device for receiving data, an output device for outputting data in tangible form (e.g. printing or displaying on a computer screen), a permanent memory for storing data as well as computer code, and a microprocessor for executing computer code wherein said computer code resident in said permanent memory will physically cause said microprocessor to read-in data via said input device, process said data within said microprocessor and output said processed data via said output device.

Figure 1:
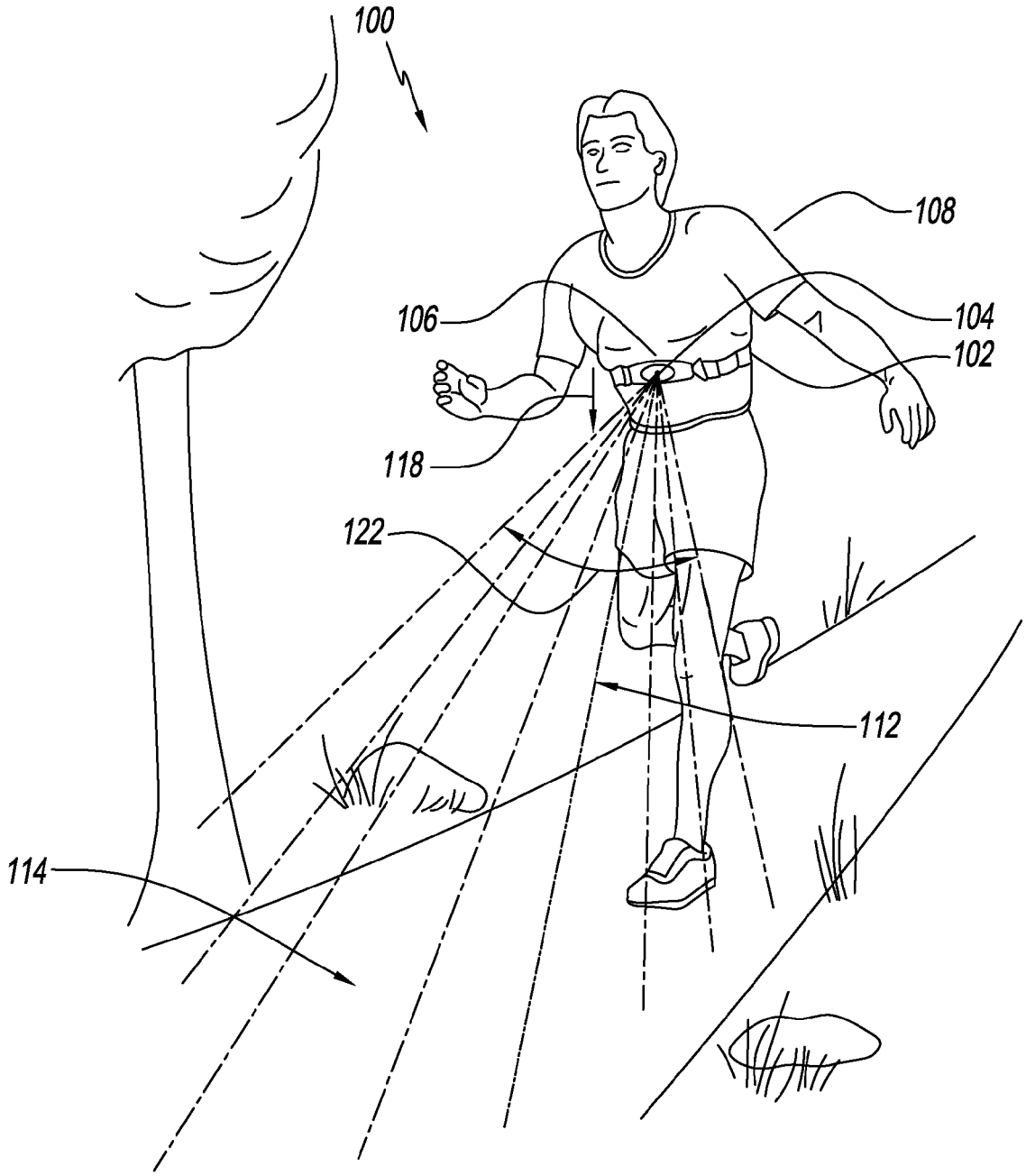
FIG. 1 (Prior Art)
FIG. 1 is an illustration of a prior art illumination light system worn by a runner.
Figure 2:
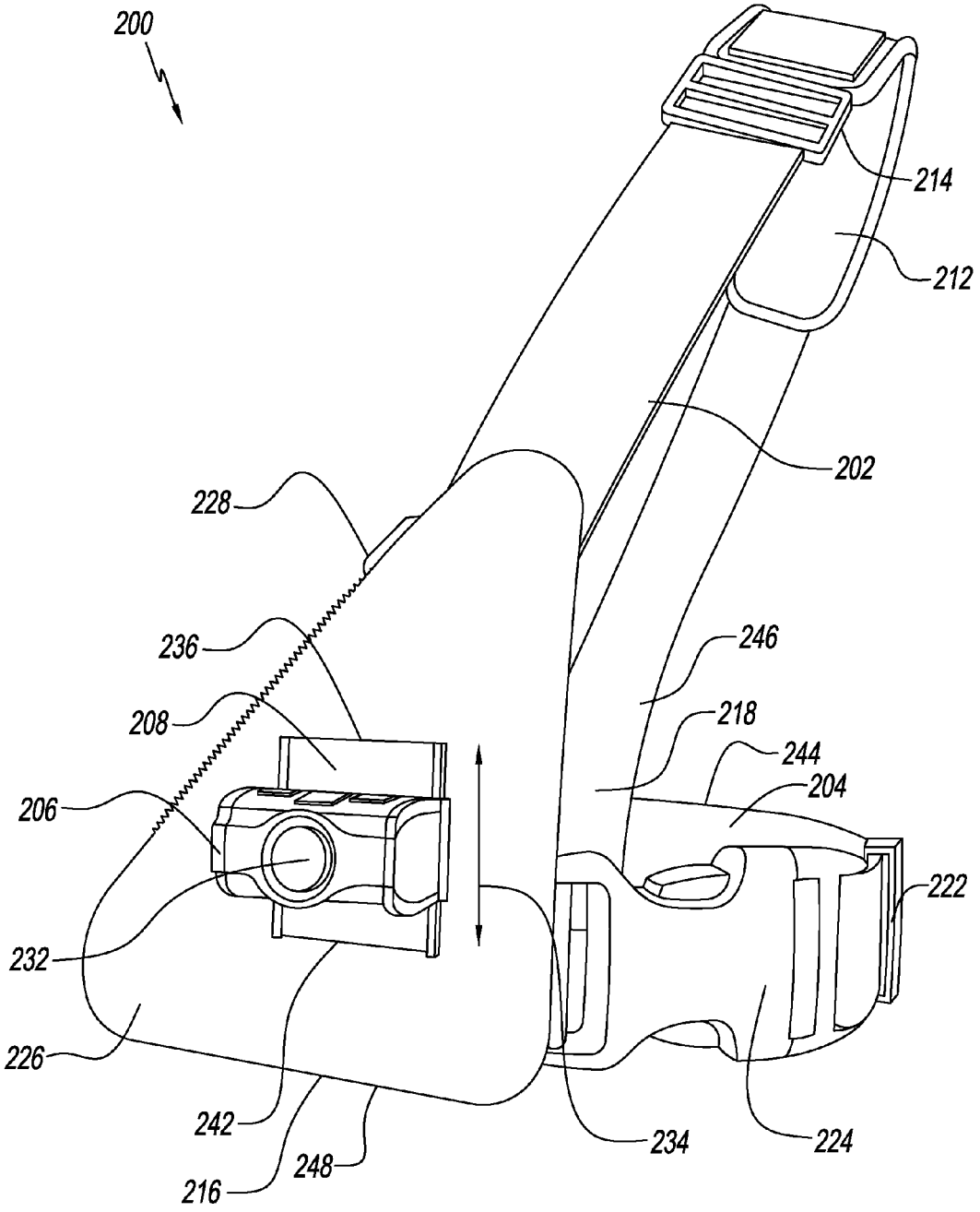
FIG. 2 is a front perspective view of an illumination harness.

FIG. 2 is a front perspective view of an illumination harness 200. The illumination harness comprises a shoulder strap 202, a waist belt 204, an illumination light 206 and a vertical track 208. The back end 246 of the shoulder strap is attached to about the rear midpoint 218 of the waist belt. The front end 248 of the shoulder strap is attached to about the front midpoint 216 of the waist belt. Said front end is not visible in FIG. 2 but is visible in FIG. 3. An optional front pouch 226 is mounted on the front end of the shoulder strap. The vertical track is mounted on said pouch. Thus the vertical track is in effect mounted on said front end of said shoulder strap using said pouch. The bottom edge 242 of said vertical track is within 2 cm of the top edge 244 of said waist belt. The height 234 of the vertical track may be in the range of 5 to 15 cm. The illumination light is frictionally mounted on said vertical track such that the vertical position of said illumination light on said track can be adjusted by hand but said illumination light will stay in position when released and hanging under its own weight. The lens 232 of the illumination light faces forward and optionally downward to project a beam of light.

The shoulder strap may comprise a shoulder pad 212 and a strap adjuster 214. The shoulder pad provides comfort to the user. The strap adjuster allows the user to adjust the strap to a desired length. The waist belt comprises a belt adjuster 222 and a buckle 224. The belt adjuster allows the user to adjust the waist belt to a desired length. The buckle allows the user to easily put on and remove the harness. The vertical track may have an open top 236 so that the illumination light can be slid on or slid off of the track. The front pouch may comprise a zipper 228 for opening and closing.

The straps may be made of conventional strap material such as webbing or other woven fabric. The buckle may be made of metal or plastic. The light may be made of plastic, metal, other materials for electronics, and a light source, such as an LED. Batteries may also be provided. Materials may be held together by stitching, glue, rivets and other joining means.

Figure 3:
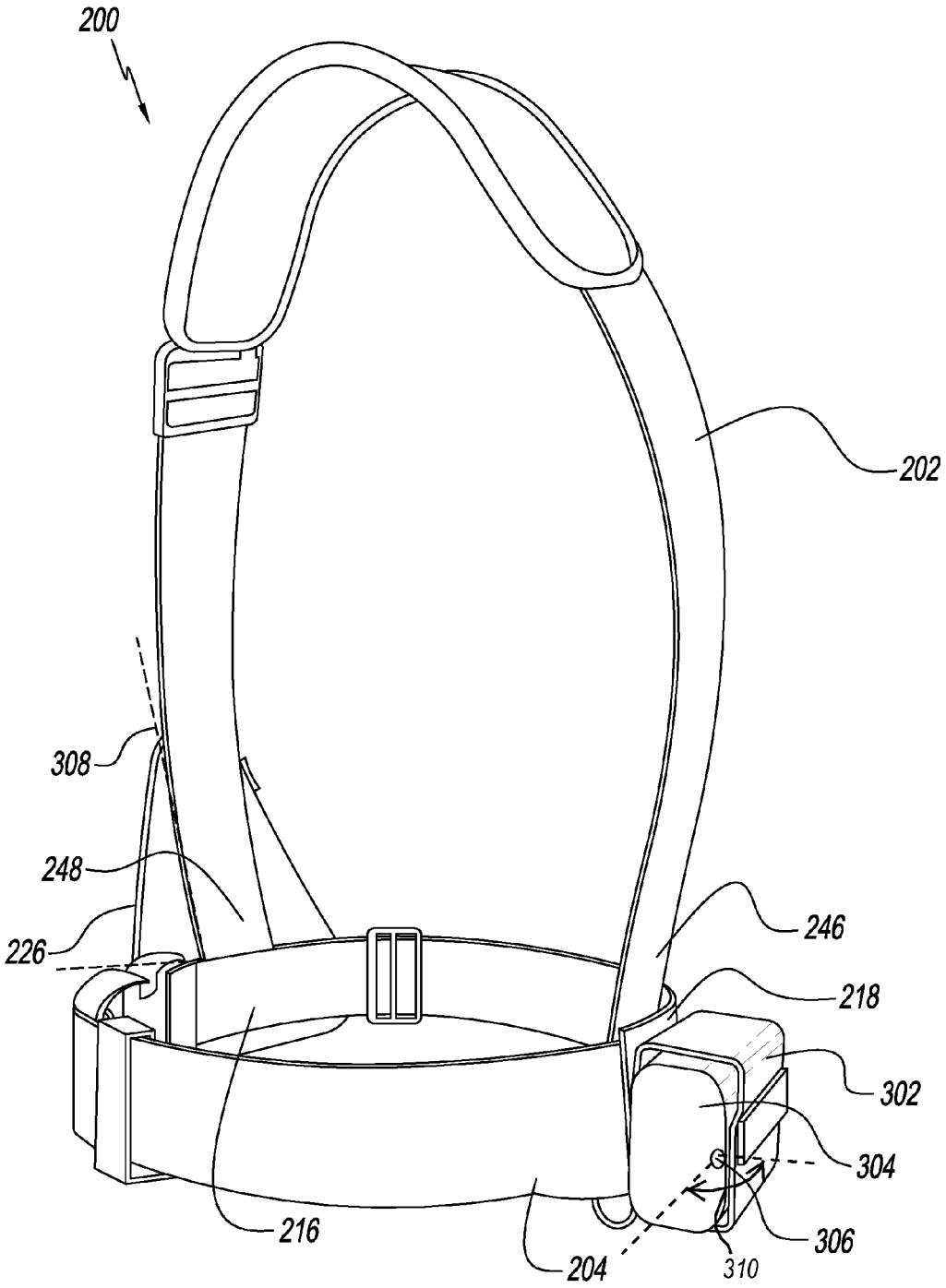
FIG. 3 is a rear perspective view of the illumination harness of FIG. 2.

FIG. 3 is a rear perspective view of the illumination harness 200 of FIG. 2. A battery pack 304 is mounted at about the rear midpoint 218 of the waist belt 204. The battery pack is held on the waist belt by a rear pouch 302. The rear pouch may comprise two flaps of webbing reversibly joined by a hook-and-loop fastening material, such as Velcro®. Electric power is conveyed from the battery pack to the illumination light by a wire (not shown).

One or more rear visibility lights 306 may be mounted on the back of the battery pack. As used herein, a "visibility light" is designed to help an observer, such as the driver of a car, see the person wearing the harness. The light emitted from a visibility light, therefore, has a wide divergence angle 310 of at least 90 degrees.

The front end 248 of the shoulder strap is attached to the front midpoint 216 of the waist belt at a strap angle 308 that is less than 90 degrees. This allows the strap to lay flat on a user's chest as it proceeds up and over said user's shoulder. The front pouch 226 is attached to both the waist belt and the shoulder strap to provide extra support for the strap angle.

Figure 4:
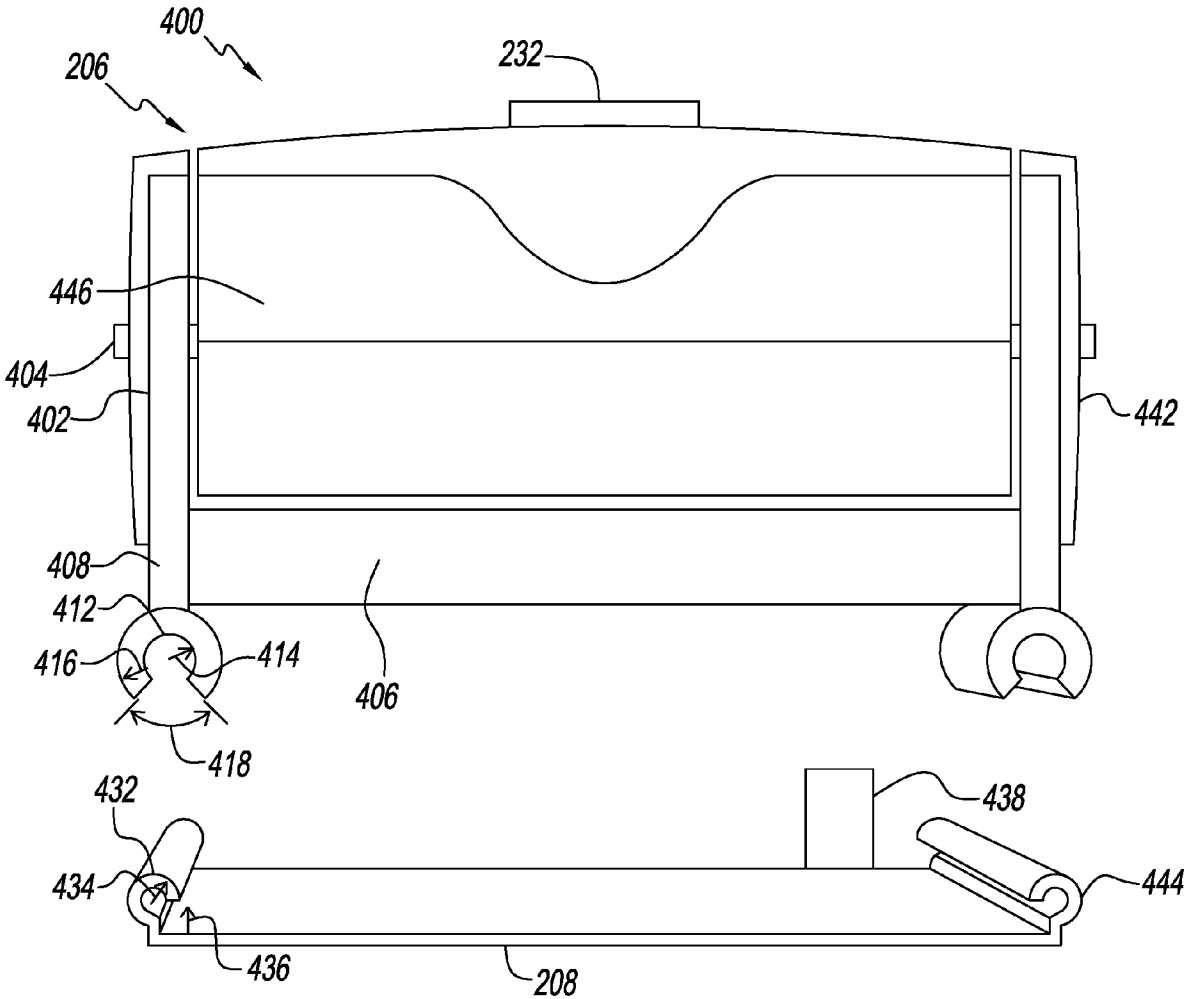
FIG. 4 is a top perspective exploded view of the light and vertical track of FIG. 2.

FIG. 4 is a top perspective exploded view 400 of the illumination light 206 and vertical track 208 of FIG. 2. The lens 232 is in front of the light. The light comprises a light body 446, left side frame 402, right side frame 442 and a cross bar 406 joining said left and right side frames. The light body is joined to each side frame by a horizontal hinge 404. This allows the user to tip the lens up or down. Each side frame comprises a backward directed leg 408 that terminates in a backward directed open cylindrical cavity 412. The cylindrical cavity is described by an internal radius 414, a wall thickness 416 and an opening angle 418. As used herein, "cylindrical" means that an object has a uniform cross section over a length. The cross section may or may not be circular.

The vertical track is a flat sheet with a forward directed left cylindrical rail 432 on its left side and a forward directed right cylindrical rail 444 on its right side. Each cylindrical rail can be described by an external radius 434 and a standoff 436. The track may additionally comprise a bottom stop 438 to prevent the light from sliding off of the bottom of the track.

The cylindrical cavities and cylindrical rails are dimensioned to provide a frictional fit. The internal radii of the cavities, for example, may be smaller than the external radii of the rails so that the cavity walls will bend out slightly when the cavities are slid onto the rails. This provides the friction needed to hold the light in a particular position after it is slid there. Routine experimentation can be used to select proper dimensions.

Figure 5:
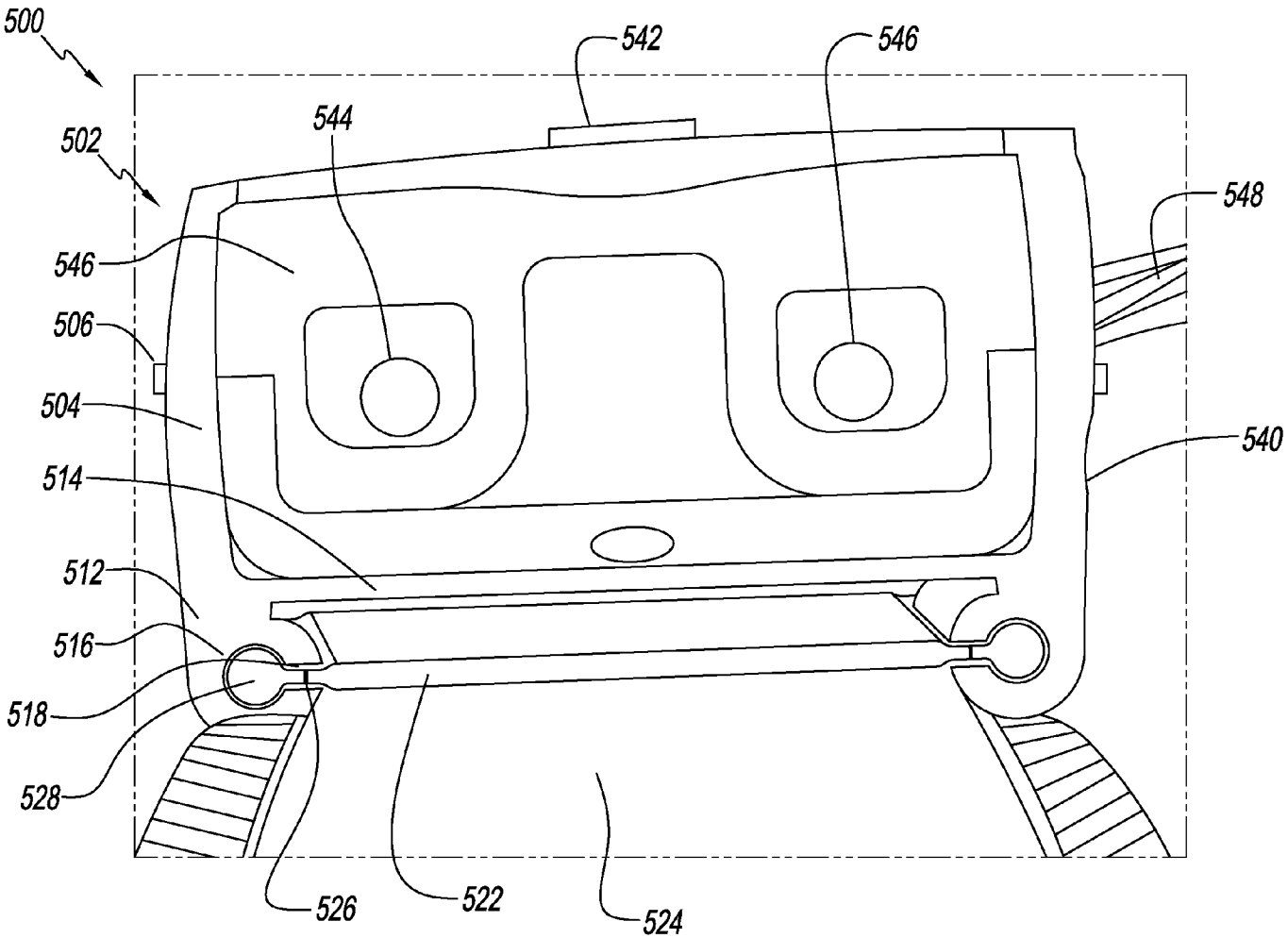
FIG. 5 is a top view of a prototype light mounted on a vertical track.

FIG. 5 is a drawing 500 of a top view of a prototype illumination light 502 mounted on a vertical track 522. The illumination light comprises a body 546, left side frame 504, right side frame 540 and cross bar 514. The cross bar rigidly connects the left and right side frames. The body is joined to each side frame with a horizontal hinge 506. Thus the light can be rotated up and down.

The body of the illumination light comprises a power switch 544, forward facing lens 542 and mode switch 546. The light is connected to a battery pack (not shown) by a multiconductor wire 548. The multiconductor wire also connects the switches to a control circuit (not shown) housed with the battery pack. The power switch activates the light and the mode switch determines the mode of the light's operation. Modes for the light may include high power, low power and flashing. The light source within the light may be a light emitting diode (LED) or any other electrically powered light emitting technology.

Each side frame terminates in a backward directed leg 512. Each leg terminates in an open cylindrical cavity 516. The openings 518 in the cylindrical cavities are directed inwardly at each other. The vertical track 522 is made of several layers of stiff fabric. The sides of the vertical track are stitched 526 to form outward directed piping 528. The piping serves as cylindrical rails on the vertical sides of the track. The vertical track is attached to a shoulder strap 524 by stitching. The external radius of the piping is larger than the internal radius of the cylindrical cavities. The piping, however, is compressible. This allows the piping to be slid into the cavities and provides an outward pressure for the frictional fit.

Figure 6B:
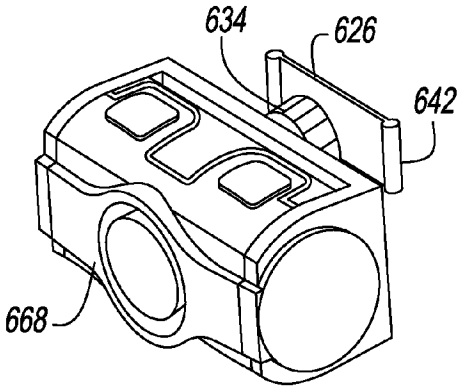
FIG. 6B is a perspective view of the illumination light of the illumination harness of FIG. 6A.
Figure 6C:
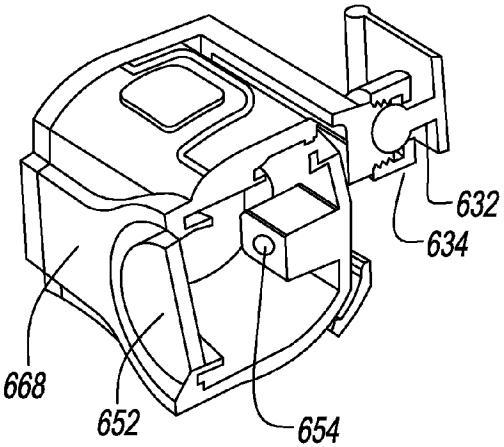
FIG. 6C is a perspective view of a vertical cross section of the illumination light of FIG. 6B.
Figure 6A:
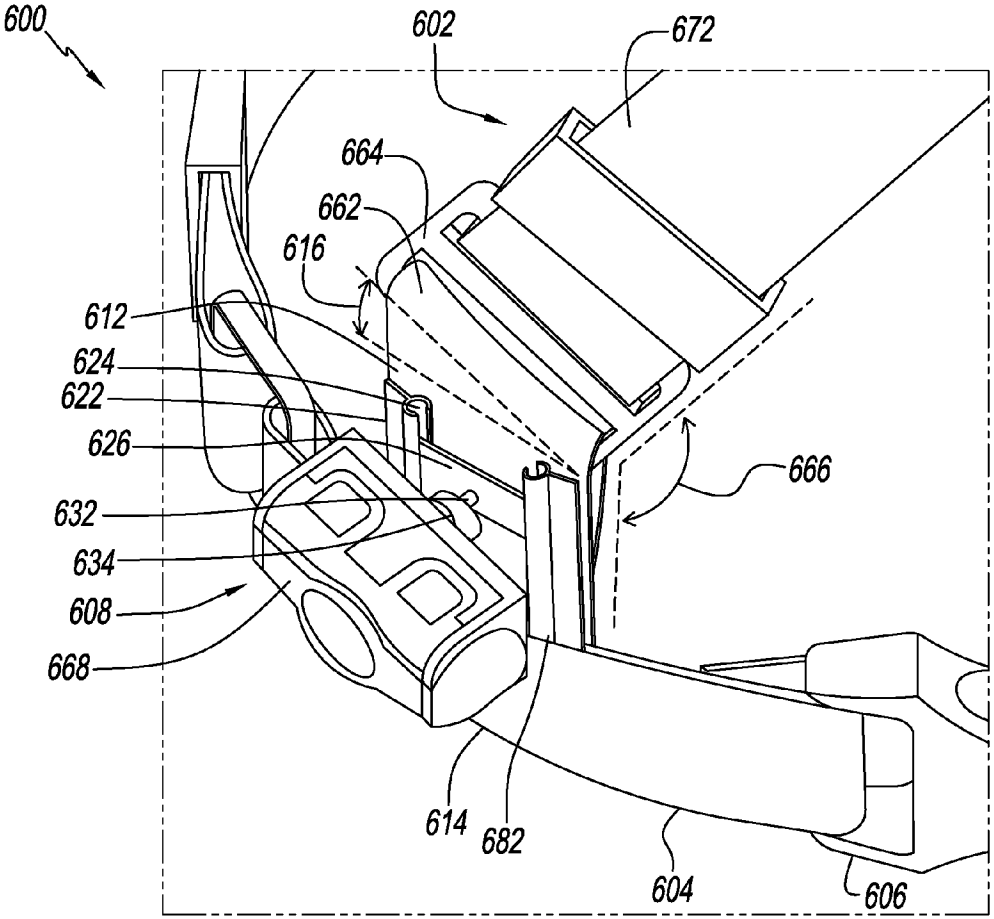
FIG. 6A is a partial perspective upper view of the front of an alternative illumination harness.

FIG. 6A is a partial perspective upper view of the front of an alternative illumination harness 600. The illumination harness comprises a shoulder strap 602, waist belt 604, illumination light 608, and vertical track 622. The front end of the shoulder strap is a vertical web 612. The waist belt comprises a buckle 606. The vertical web proceeds up from about the front midpoint 614 of the waist belt. The upper end of the vertical web terminates in a loop 662. The upper portion 672 of the shoulder strap is connected to the loop by a rectangular ring 664 with a central crossbar. The loop is at a top angle 616 so that the upper portion of the shoulder strap is at a desired strap angle 666.

The vertical track 622 comprises a right channel 624 and a left channel 682. The channels are made from stiff material, such as metal or plastic. They are attached to the vertical web. Attachment may be by stitching. The channels inwardly face each other.

The light comprises a light body 668 and a horizontal mounting bar 626. Each of the left and right end of the mounting bar comprises a rail 642 (FIG. 6B). The rails are frictionally fit within the channels. A stud 632 proceeds forward from about the center of the mounting bar. The stud is joined to the light body by a hand tightenable ball joint 634. Thus the direction of the light can be adjusted by loosening the ball joint, setting the direction, and then tightening the ball joint.

FIG. 6B is a perspective view of the illumination light of the illumination harness of FIG. 6A. The rails 642 on the mounting bar 626 are visible.

FIG. 6C is a perspective view of a vertical cross section of the illumination light of FIG. 6B. The structure of the ball joint 634 and stud 632 can be seen. A light source 654 within the light body 668 can also be seen. A cross section of a lens 652 is also shown.

Figure 7B:
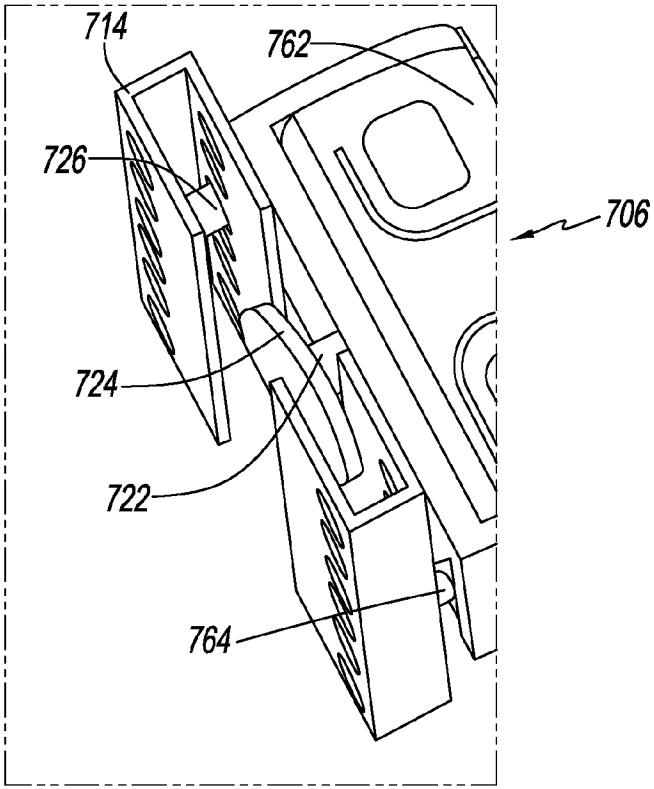
FIG. 7B is a top view of the illumination light and U channels of the illumination harness of FIG. 7A.
Figure 7A:
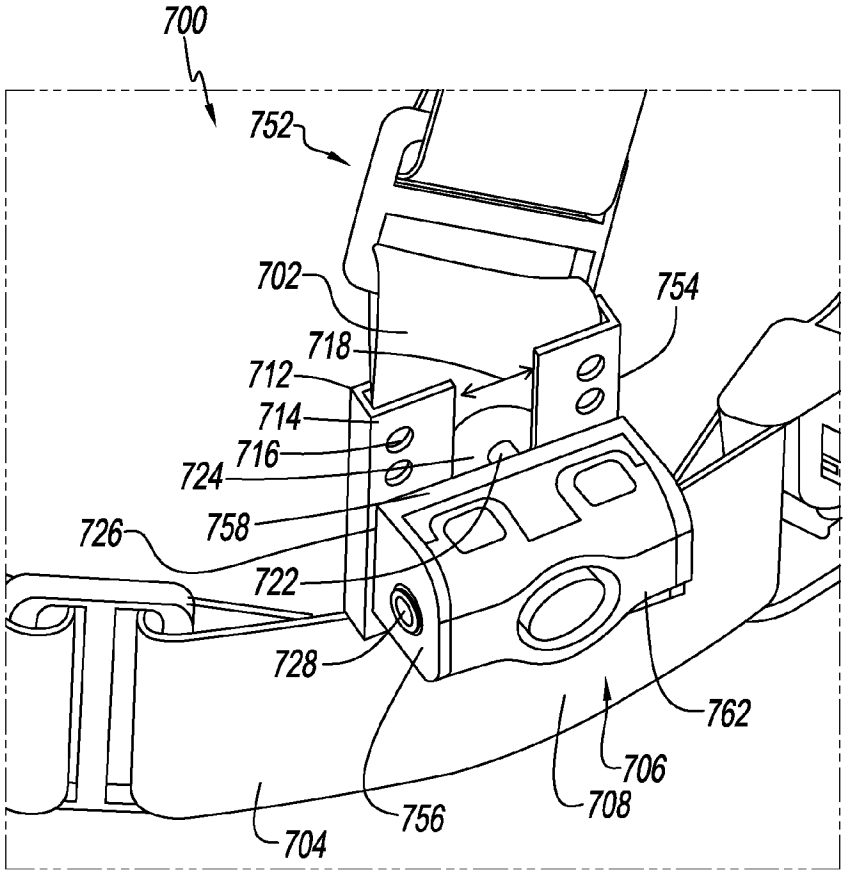
FIG. 7A is a front perspective partial view of an alternative illumination harness.

FIG. 7A is a front perspective partial view of an alternative illumination harness 700. The illumination harness comprises a shoulder strap 752, a waist belt 704, and an illumination light 706. The font end of the shoulder strap is a vertical web 702. The vertical web is attached to about the front midpoint 708 of the waist belt. The vertical track 712 comprises a left U channel 754 and a right U channel 714. The U channels are mounted around the edge of, and are attached to, the vertical web such that there is a vertical gap 718 therebetween. Each U channel comprises a vertical array of holes 716.

The light comprises a body 762, a frame 756, and a plate 724. The body is attached to the frame by a horizontal hinge 728. The frame comprises a cross bar 758. The plate is mounted on a spring loaded stud 722. The spring loaded stud urges the plate forward towards the cross bar. A left and right peg 726, 764 (FIG. 7B) proceed rearward from the cross bar. Each of the pegs is aligned with one of the vertical array of holes and is dimensioned to fit within said holes. The width of the plate is larger than the horizontal spacing between the U channels. Thus the plate will hold the U channels against the cross bar and engage the pegs in the holes. This keeps the light from slipping down as a runner runs and is considered a frictional fit. The user can change the position of the light by pulling the light forward, disengaging the pegs with the holes, sliding the light up or down and releasing the light so that the spring pulls the light back and engages the pegs with an appropriate set of holes.

FIG. 7B is a top partial view of the illumination light 706 and U channels 714 of FIG. 7A. The pegs 726, 764 can be seen.

EXAMPLE 1

Figure 8:
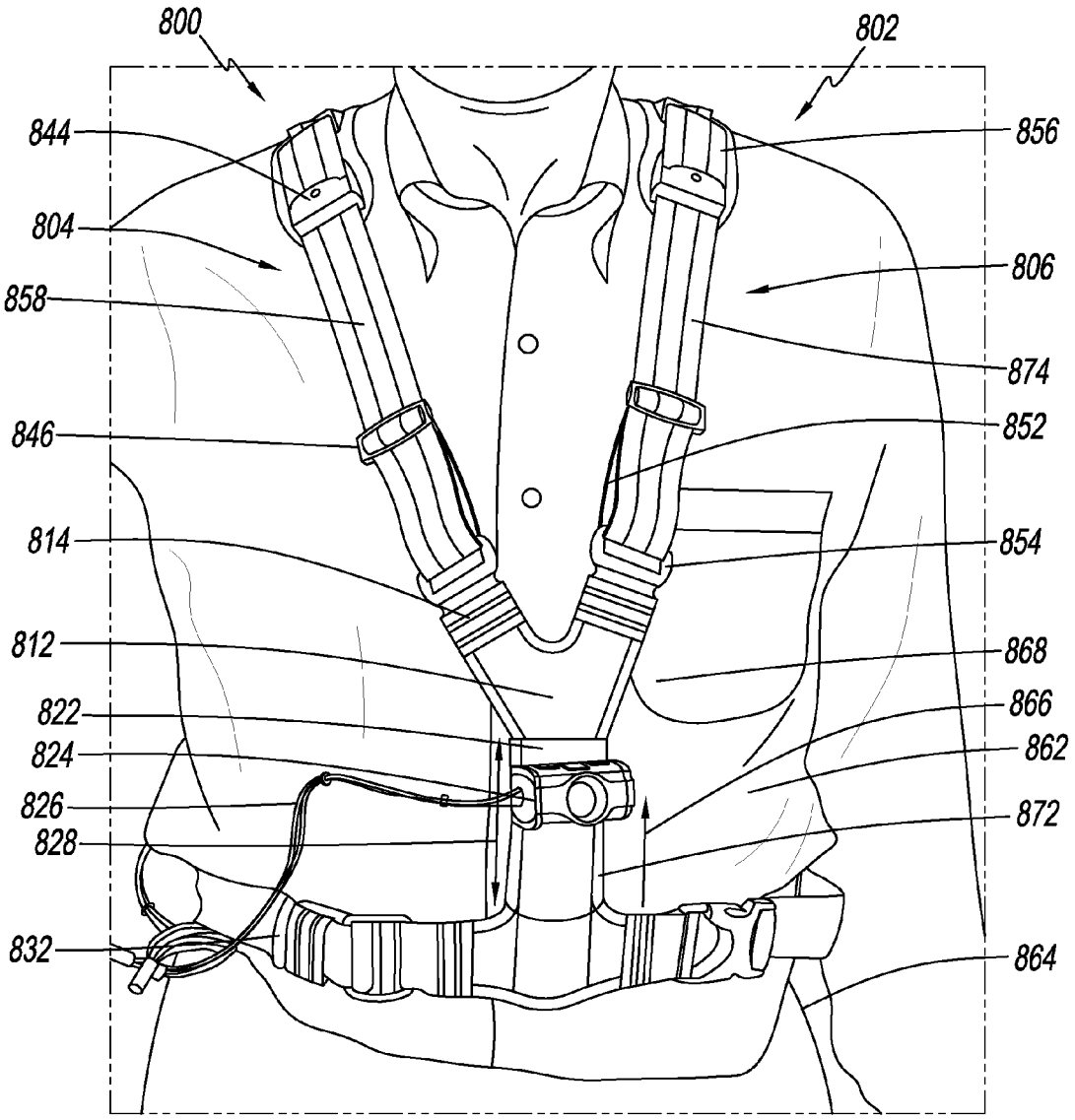
FIG. 8 is a drawing of an alternative embodiment of an illumination harness being worn by a male adult.

FIG. 8 is a drawing of an embodiment of an illumination harness 800 on a male adult 802. The illumination harness comprises a left shoulder strap 806, right shoulder strap 804, waist belt 832, vertical track 822, and illumination light 824. The vertical track is mounted on a vertical web 812. The vertical track has a height 828 of about 9 cm. The vertical web is defined as being the front end of either the left or right shoulder strap. The vertical track comprises vertical piping 872. The illumination light and vertical track are the same as those illustrated in FIG. 5. A battery pack and control circuit are mounted on the back of the waist belt (not shown). The battery pack is connected to the light with a multistrand wire 826. The vertical web comprises a branching top 814 which connects to each one of the upper portions 874 of the shoulder straps at a desired angle. A similar vertical web with branching top is in the rear of the harness (not shown) and connects the back of the straps to the back of the waist belt. Each upper portion of a shoulder strap comprises a strap adjuster slider 846 attached to a bottom end 852 of the upper portion. Each bottom end of an upper portion passes through a rectangular ring 854 at the top of one of the branches. Each shoulder strap comprises a strap adjuster clip 844 through which the top of an upper portion 856 passes through. Thus the length of each shoulder strap can be adjusted by a combination of adjusting the slider and adjusting how much strap passes through the clip. The front of each upper portion also comprises a reflective strip 858.

The male in FIG. 8 is about 1.8 meters tall and has a protruding belly 862. Thus the male adjusted the straps so that the waist belt was below his belly and close to his hips 864. The male then slid the illumination light to the top of the vertical track 866 so that the light was near his torso center 868.

Figure 9:
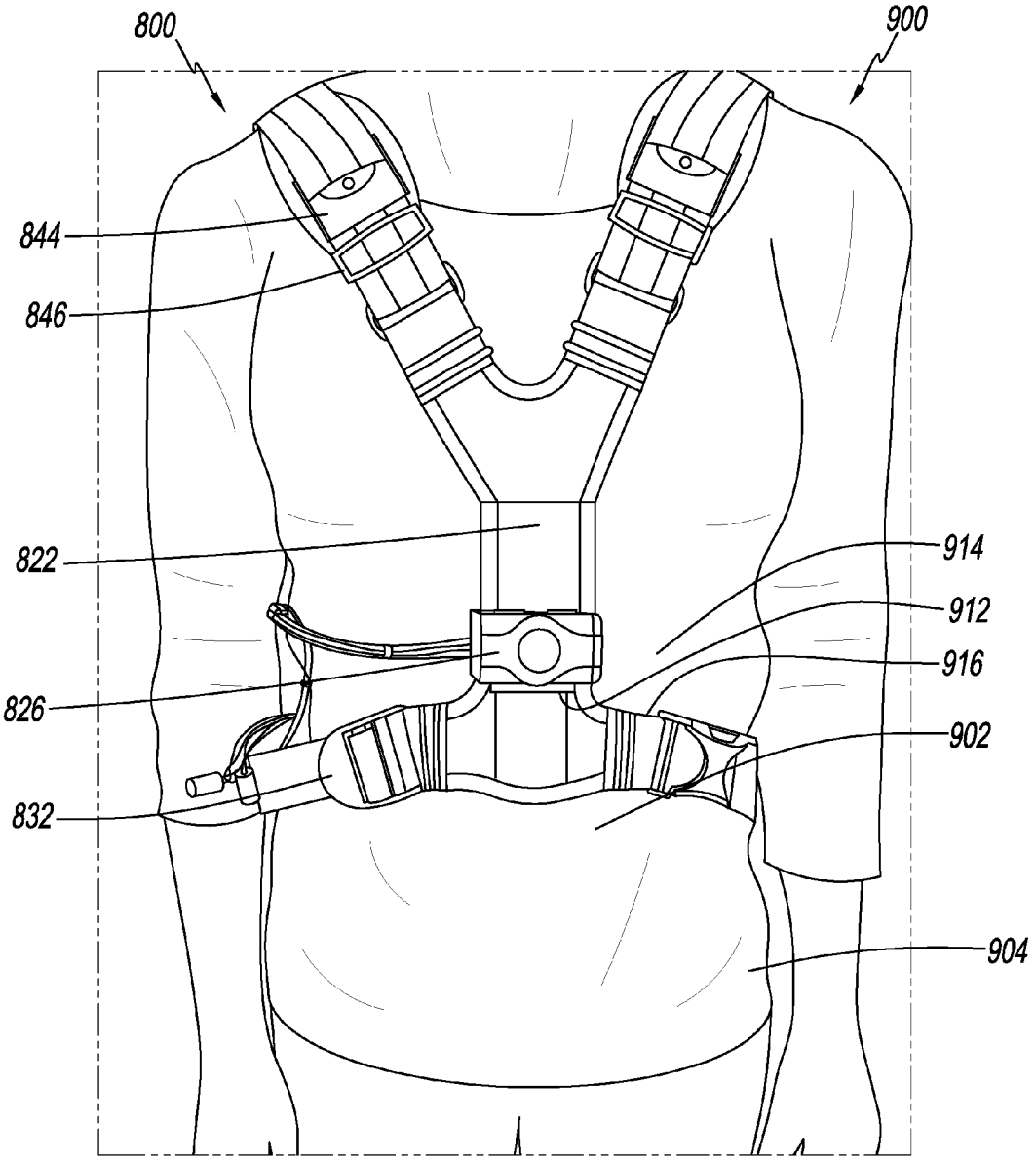
FIG. 9 is a drawing of the illumination harness of FIG. 8 being worn by a female adult.

FIG. 9 is a drawing of an adult female 900 wearing the same illumination harness 800 of FIG. 8. The female is about 1.6 meters tall and has a trim belly 902. Thus the female adjusted the shoulder strap clips 844 and sliders 846 so that the waist belt 832 was over her belly and well above her hips 904. The female then positioned the illumination light 826 near the bottom edge 912 of the vertical track 822 to keep the light near her torso center 914. The bottom edge of the vertical track was about 1 cm above the top edge 916 of the waist belt.

EXAMPLE 2

Figure 10A:
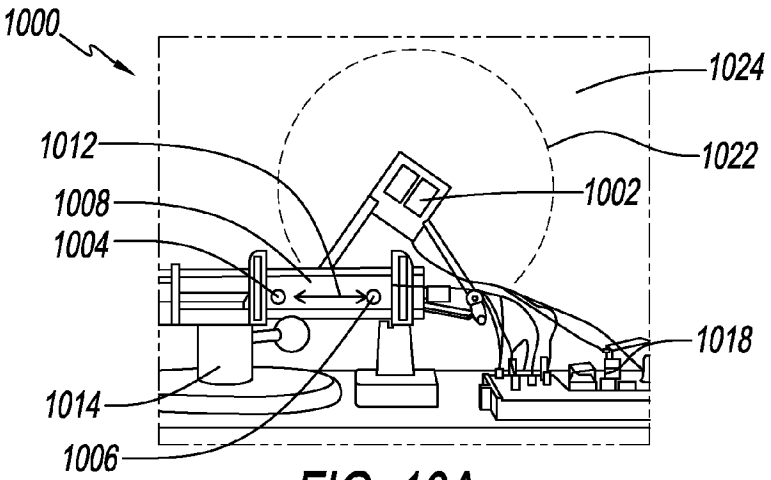
FIG. 10A is a drawing of a breadboard light system for an illumination harness.

FIG. 10A is drawing of a rear view of a breadboard light system 1000 for an illumination harness. The system comprises a forward facing illumination light 1002, a rear visibility light assembly 1008, a controller circuit board 1018 and a power supply (not shown). The rear visibility light assembly comprises a rear facing left visibility light 1004 and a rear facing right visibility light 1006. The assembly is held in a vice 1014. The left and right visibility lights are separated by a distance 1012 of about 8 cm. 3 cm or more is considered adequate separation. The left visibility light is red. The right visibility light is blue. The different colors enhance the attention getting power of the visibility lights. In FIG. 10A, the illumination light is on and lights up an illumination area 1022 on a wall 1024 in front of the light system.

The controller may comprise a microprocessor and computer readable instructions stored on a permanent memory to physically cause the microprocessor to carry out a set of steps in operating the lights according to a mode selected by a user. Different modes may include different combinations of low power illumination light, high power illumination light and various combinations of flashing of the different lights. The timing of light flashing can be set to even multiples of the clock in the microprocessor for more efficient programming and operation.

The visibility lights and/or illumination light may be flashed in order to enhance their attention getting ability. A suitable flash sequence is three quick flashes of the left illumination light followed by a gap in time and then three quick flashes of the right illumination light followed by another gap in time. The flashing is then repeated. An individual flash duration of 40 milliseconds or more is adequate for visual perception. 50 milliseconds is a suitable choice. 50 milliseconds is also a suitable period between individual flashes. 100 milliseconds is a suitable gap in time between left and right flashing. The period between successive flashes can be chosen for convenience. A period of 8/5 seconds, however, should be avoided since that period can stimulate seizures on some people.

The illumination light can also be flashed. This may be desirable at dawn or dusk when the runner does not need to illuminate the path ahead, but wants enhanced visibility from the front. The illumination light can be flashed during the period between the flashing of the left visibility light and the right visibility light. This keeps the peak current draw on the power supply low since only one light is on at any given time.

Figure 10B:
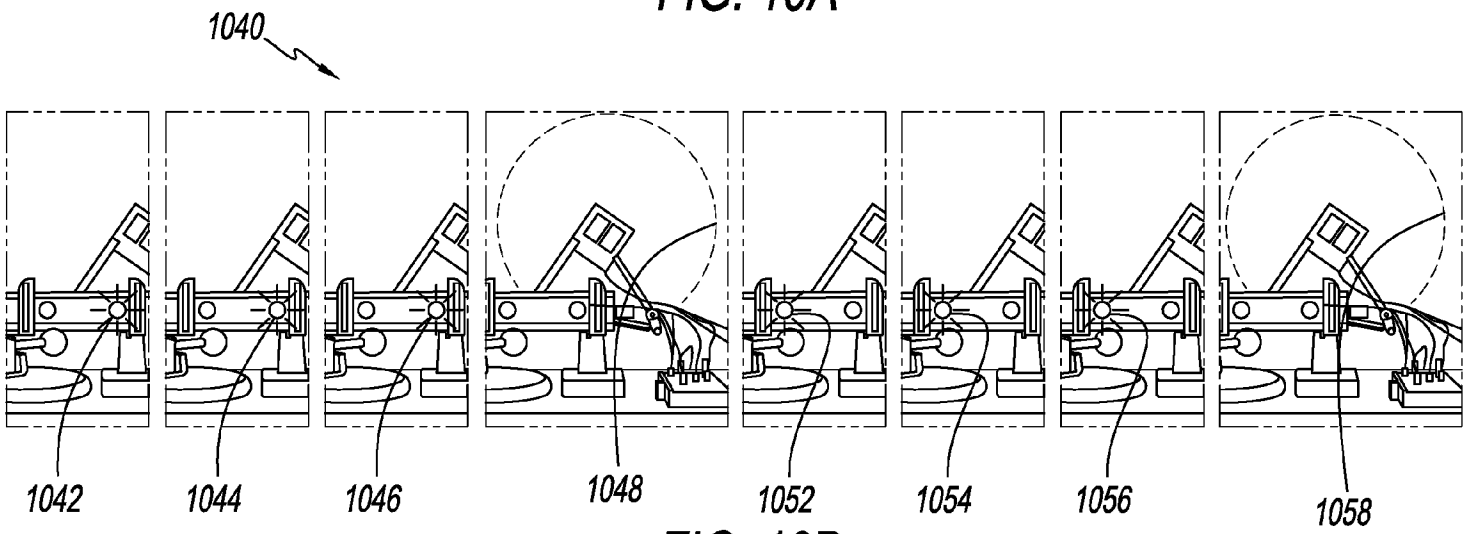
FIG. 10B are drawings of successive partial frames of a video recording the flashing sequence of the lights of the light system of FIG. 10A.

FIG. 10B is series of drawings of successive partial frames 1040 of a video recording of a flashing sequence. Three blue flashes of the right visibility light 1042, 1044 and 1046 are followed by a flash of the illumination light 1048. This is followed by three flashes of the red left visibility light 1052, 1054 and 1056. The front illumination light is then flashed again 1058 to complete the cycle. The cycle is then repeated. The total period of the cycle is about 1 second.

CONCLUSION

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. Therefore, it is intended that the disclosure not be limited to the particular embodiment disclosed as the best mode contemplated for carrying out this invention.

We claim:

1. An illumination harness comprising:

a) a waist belt comprising a top edge, a front midpoint and a rear midpoint;

b) a shoulder strap comprising:

i) a front end attached to said waist belt at about said front midpoint of said waist belt, said front end being at a strap angle with respect to said waist belt of less than 90 degrees; and ii) a back end attached to said waist belt at about said rear midpoint of said waist belt;

c) a triangular pouch comprising a front and a back, said back of said pouch being attached to said front end of said shoulder strap and said waist belt to provide extra support for said strap angle;

d) a vertical track comprising an upper edge and a bottom edge, said vertical track being attached to said front of said triangular pouch; and e) an illumination light frictionally mounted on said vertical track such that the vertical position of said illumination light on said track can be adjusted by hand but said illumination light will stay in position under its own weight.

2. The illumination harness of claim 1 wherein said shoulder strap comprises a strap adjuster and said waist belt comprises a belt adjuster and a buckle.

3. The illumination harness of claim 1 wherein said vertical track comprises an open top such that said illumination light can be slid off of said vertical track.

4. The illumination harness of claim 1 wherein said bottom edge of said vertical track is within 2 cm of said top edge of said waist belt.

5. The illumination harness of claim 1 wherein said vertical track has a height in the range of 5 to 15 cm.

6. The illumination harness of claim 1 which comprises only one shoulder strap.

7. The illumination harness of claim 1 wherein said vertical track comprises a bottom stop that will prevent said illumination light from sliding down off of said vertical track.

8. The illumination harness of claim 1 wherein:

a) said illumination light comprises i) a light body;

ii) a horizontal mounting bar comprising left and right rails;

iii) a stud; and iv) a ball joint;

b) said front end of said shoulder strap comprises a vertical web; and c) said vertical track comprises:

i) a left U channel; and ii) a right U channel wherein:

d) said stud proceeds forward from said mounting bar and attaches to said light body with said ball joint;

e) said vertical web proceeds up from about said front midpoint of said waist belt;

f) said left U channel and said right U channel are attached to said vertical web; and g) said rails are frictionally fit in said channels.

9. The illumination harness of claim 1 wherein:

a) said front end of said shoulder strap comprises a vertical web;

b) said vertical track comprises:

i) a left U channel; and ii) a right U channel;

c) said U channels each comprise a vertical array of holes;

d) said U channels are mounted around the edge of and attached to said vertical web such that there is a vertical gap therebetween;

e) said illumination light comprises a frame; and f) said frame comprises:

i) a cross bar;

ii) a spring loaded plate mounted on said cross bar wherein:

1) said spring is configured to urge said plate towards said cross bar;

2) said plate has a width that is larger than said horizontal spacing between said U channels;

3) said plate is between said vertical web and said U channels; and 4) said cross bar is in front of said U channels; and iii) a left and right peg each:

1) extending rearward from said frame; and 2) is horizontally aligned with one of said vertical arrays of holes.

10. The illumination harness of claim 1 which further comprises a second shoulder strap.

11. The illumination harness of claim 1 which further comprises:

a) a battery pack mounted on said waist belt at about said rear midpoint of said waist belt; and b) a wire providing power from said battery pack to said illumination light.

12. The illumination harness of claim 11 wherein said battery pack comprises a first rear visibility light and wherein said first rear visibility light projects a light beam with a divergence angle of at least 90 degrees.

13. The illumination harness of claim 1 wherein:

a) said vertical track is a flat sheet comprising a first cylindrical rail on its right side and a second cylindrical rail on its left side; and b) said illumination light comprises a first leg on its left side and a second leg on its right side and wherein said legs each comprise an open cylindrical cavity adapted to frictionally fit on said cylindrical rails.

14. The illumination harness of claim 13 wherein:

a) said first cylindrical rail is described by an external radius;

b) said open cavity on said first leg is described by an internal radius; and c) said internal radius is less than said external radius.

15. The illumination harness of claim 13 wherein said vertical track is made from a web of material and wherein said cylindrical rails are fabric piping.

* * * * *